United States Patent [19]

Barthelemy et al.

[11] Patent Number: 4,742,876

[45] Date of Patent: May 10, 1988

[54] SUBMARINE DRILLING DEVICE

[75] Inventors: Hervé Barthelemy, Croissy; Karl Bollinger, Rueil; Michel Brochier, Palaiseau; Maurice Gau, Maurepas; Yves Legendre, Bazoches les Bray, all of France

[73] Assignee: Soletanche, Nanterre, France

[21] Appl. No.: 917,453

[22] Filed: Oct. 9, 1986

[30] Foreign Application Priority Data

Oct. 9, 1985 [FR] France ..... 85 14939

[51] Int. Cl.[4] ..... E21B 7/128

[52] U.S. Cl. ..... 175/7; 175/94; 175/99; 175/189

[58] Field of Search ..... 175/6, 7, 94, 97, 99, 175/171, 189, 321

[56] References Cited

U.S. PATENT DOCUMENTS 3,137,348 6/1964 Ahlstone et al. ..... 175/7
3,894,587 7/1975 Sourice ..... 175/97

FOREIGN PATENT DOCUMENTS 60261 6/1973 Australia .
1634262 3/1970 Fed. Rep. of Germany .
2034182 3/1970 France .
2252947 5/1975 France .
2398846 9/1979 France .
1071157 1/1967 United Kingdom .
2010360 2/1979 United Kingdom .

*Primary Examiner*—Stephen J. Novosad
*Assistant Examiner*—William P. Neuder
*Attorney, Agent, or Firm*—Charles W. Fallow; Martin P. Hoffman; Mitchell B. Wasson

[57] ABSTRACT

A device for submarine foundation drilling includes: a drilling unit including a head and body interconnected by at least one cylinder, the body being equipped with at least one cutter, the drilling unit being equipped with at least one excavating pump, and hydraulic motors to operate the cutter and the pump; a rigid tubular assembly (2) containing at least one discharge pipe, and pipes for feeding hydraulic fluid to the cylinder and the motors; connecting means (12) between the head of the drilling unit and the lower part of the tubular construction; support means (13) able to be placed at the ocean bottom in front of the head of the drilling unit, means for clamping the tubular assembly; means for suspending the device from a ship, means (5) being provided to furnish hydraulic power, and connecting pipes being provided between the means of furnishing fluid and the upper end of the tubular assembly.

21 Claims, 11 Drawing Sheets

7
9
5
6
4
8
3
2
10
11
17
16
16
17
15
13
12
20
19
14
18
1

61
60
X
55
56
57
51
61
55
66
65
56
51
59

2
13
16
40
1
105
106
23
26
107

16
23

16
23
1

2
16
23
1

16
23
1

16
23
1
26

2
16
105
40
23
1
26

SUBMARINE DRILLING DEVICE

BACKGROUND

The present invention concerns a device for the drilling of submarine foundations.

Until now, this type of drilling has been completed with standard rotating tools driven from a ship or a platform by an intermediate rod string.

However, the working of hydrocarbon fields at great depths has increasingly relied on production platforms that require extremely strong anchorage points. This is the case, for example, of the so-called "taut cable" platforms.

Such anchorage points, able to support vertical or horizontal forces on the order of 1000 or 2000 tons, call for the construction in the ground, below several hundred meters of ocean water, of posts several square meters in cross-section and several tens of meters high, and consequently call for the construction of corresponding drills.

Now, very large diameter rotary drilling poses problems that are nearly impossible to solve.

Firstly, the raising of cuttings, either in direct or reverse circulation, requires extremely high supplies of water or air.

Additionally, since the torque to be transmitted to the tool for rotating it, as well as the vertical force to be applied to this tool, are very large, the rods used have large diameters, and are consequently very bulky, heavy, fragile and expensive. Additional problems arise because of the tubing of surface ground.

This invention aims to remedy these difficulties by furnishing a drilling device with a massive capacity in which the above difficulties will be resolved, and more particularly, those difficulties tied to the transfer of energy from the surface to the drilling tools.

SUMMARY OF THE INVENTION

To this end, the invention has as its object a device for underwater drilling of foundations, characterized by the fact that it includes:

a drilling unit having a head and a body interconnected by at least one hydraulic cylinder, said body being provided with at least one cutter, said unit being further equipped with at least one pump for discharging cuttings, and with hydraulic motors to drive said cutter and said pump; a rigid tubular assembly having at least one discharge pipe for discharging the cuttings, and feed pipes for feeding said cylinder and said hydraulic motors with hydraulic fluid; connecting means between said head and the lower end of said tubular assembly; supporting means able to be placed on the ocean bed in front of the drilling unit for said clamping means of said tubular assembly; and means for suspending the device from a ship; means being provided for the furnishing of hydraulic fluid, and connecting pipes provided between said fluid furnishing means and an upper end of said tubular assembly.

The body can, for example, be provided with two cutters, each equipped with horizontal axes rotating in opposite directions, as is already known in the field of mining on land.

Such an arrangement offers numerous advantages. Firstly, all the sources of power, chiefly the hydraulic cylinder, the motors of the cutters, and of the circulating pump, are located within the drilling unit. Since these power sources are hydraulic, energy transmissions from the assistant ship can be accomplished as simply as possible.

Additionally, the rigid tubular assembly to which the drilling unit is linked is maintained at the wellhead by the clamping means. Regulation of the feed of the cutters can be performed with accuracy the aid of the fed cylinder, regardless of the conditions existing between the ship and the wellhead.

It will be noted that the rigid tubular assembly must have a length at least equal to the final depth of the drill hole, since the clamping means operate upon this tubular assembly. But apart from this length, up to the assistance ship, the suspension means from the ship can be of any type, since their function is to control the raising and lowering of the device when the cutter is not in operation. In particular, these suspension means have to provide no rotational torque, which can make it possible to avoid using a rod string, if it is so desired.

It should be noted that by the term "rigid" tubular assembly is meant an assembly on which the locking means generally comprising jaws, can exert their action. Also, the term "ship" is in no way limiting and includes any type of support.

In one particular embodiment of the invention, the device comprises, at the tubular assembly's upper part, a three-channel distribution box with a two-position check valve, one of the channels being connected to the discharge pipe, a second channel being connected to a pipe for evacuation of the cuttings, and a feed pipe for the drill hole mud being connected between a third channel and a mud production unit installed on the ship, the discharge pipe being connected to the evacuation pipe in the first position of the valve, and to the mud feed pipe in the second position of the valve.

In this case, the drilling takes place under the sea water, the pipe for discharging the cuttings when actually being used for this discharge. During the raising of the drilling unit, the position of the valve is reversed, and mud is injected into the drill hole through the same pipe.

This three-channel distribution box can have a distribution chamber in which a plugging element or a check valve element is guided to move between a first seat, where it plugs the second channel's opening, and a second seat, where it plugs the opening of the third channel, the plugging element being automatically applied to the second seat when cuttings are discharged into the pipe for evacuation of those cuttings, and against said first seat when mud is injected into the mud feedpipe for the injection of this mud into the drill hole through the discharge pipe.

The plugging element can, for example, comprise a sphere guided within the distribution chamber by ribs formed on the chamber's walls.

In another embodiment of the invention, the connecting means between the head of the drilling unit and the lower end of the tubular assembly comprise a connector disposed on the lower end of the tubular assembly and operable with at least one hydraulic cylinder, said tubular assembly having feedpipes for said cylinder.

This hydraulic cylinder can, for example, be an annular cylinder whose movable part forms a skirt placed around the lower end of the tubular assembly, between two stops limiting its axial course, the connector including a plurality of gripping elements, adapted to grip a flange formed on the head of the drilling unit, said gripping elements being mounted on the periphery of the lower end of the tubular assembly, upon horizontal axis of rotation and being equipped with cam surfaces cooperating with corresponding surfaces on the skirt, so as to switch from a locking position when the skirt is in one of its axial positions, to an unlocking position when the skirt is in its other axial position.

The cylinder controlling the connector can be a single action cylinder, the skirt then being brought from its locking position to its unlocking position under the action of hydraulic fluid against the action of elastic means tending to bring the skirt back into a locked position, the gripping elements and the flange having cooperating surfaces for separating said gripping elements when said cooperating surfaces are pressed against each other.

A connector of this type allows rapid disconnection of the tubular assembly from the drilling device in case that is necessary, for example for reasons of weather. Connection of the tubular assembly to the drilling unit is also easily accomplished by a simple contact of the end of the tubular assembly to the head of the drilling unit.

To assure the angular positioning of the tubular assembly with respect to the drilling unit, the lower end of the tubular assembly and/or the head of the drilling unit can have tapered centering pins cooperating with corresponding holes in the other element, so as to cause each hole on the pipes of the tubular assembly to correspond angularly with the corresponding feed openings of the drilling unit.

In order to avoid, in case of disconnection, a loss of hydraulic fluid, the lower ends of each hydraulic fluid pipe of the tubular assembly, as well as the corresponding feed openings of the drilling device's head, can be equipped with valves made to shut when the assembly's lower end is disconnected from the drilling unit, and to open when this lower end is connected to the drilling unit.

To make possible relative movement of the head and the body of the drilling unit under the action of the feed cylinder, the outlet of the pump for discharging cuttings can be connected to the head of the drilling unit by a telescoping discharge pipe.

Also in a particular embodiment of the invention, the support means of the clamping means comprise a lower structure with first guide surfaces for the lower part of the drilling unit, and an upper structure provided with guide surfaces able to cooperate with second guide surfaces of the lower structure, the clamping means being mounted on said upper structure.

The first guide surfaces of the lower structure make it possible to bring the drilling unit back into the drill hole when, for one reason or another, it has been withdrawn before completion of the drilling. As for the guide surfaces of the upper structure, they make it possible to reposition suitably the clamping means with respect to the tubular assembly.

The device according to the invention can also comprise means for coupling a tubing around the drilling unit, that can be operated with hydraulic cylinders, said tubular assembly having feedpipes for said cylinders.

Such an arrangement is useful, particularly when the ocean bottom exhibits a very weak cohesiveness. In this case, a tubing is coupled to the drilling unit and consequently is lowered, at least to a certain depth, at the same time that the drilling is taking place.

These coupling means, for example, can comprise shoes mounted on opposite faces of the drilling unit.

Preferably, when the placement of such a tubing has been provided, the cutters are mounted to swing around horizontal axes, hydraulic cylinders being provided to cause their swinging, and the tubular assembly comprises feedpipes for these cylinders.

Actually, to be able to raise the drilling unit while leaving the tubing in place, the drilling unit must have a section with dimensions slightly smaller than those of the inner diameter of the tubing. By causing the cutters to swing, a drill hole can be made whose dimensions correspond to those of the tubing and consequently facilitate its descent.

In one particular embodiment, the rigid tubular assembly is extended to the ship.

However, it has been noted above that it is enough that it has a height equal to the depth of the drill hole, the connection to the ship being made by any suitable means.

The rigid tubular assembly may be made in the form of connectable sections, each of the sections having a central pipe for discharging the cuttings and/or injecting of the mud, and feedpipes for hydraulic fluid disposed at the periphery of the central pipe, means being provided to assure the relative angular positioning of two adjacent sections, so as to make the openings of their homologous feedpipes correspond.

These positioning means can comprise conical centering pins placed on at least one end of each section, so that they work with corresponding holes in the opposite end of the adjacent section.

In order to permit the filling of the feedpipes with hydraulic fluid prior to assembling the tubular assembly, there can be provided, at each end of these pipes of a section, a valve made to be closed when this section is not joined at its end, and to be opened when the section is joined at its end to an adjacent section.

Each section, moreover, can have an outer protective sheath, the feedpipes for hydraulic fluid being arranged in the annular space between the central pipeline and the outer sheath.

Advantageously, the hydraulic fluid feedpipes are mounted to slide at their ends, into a tip solid with the end of the central pipe.

It is thus possible to subject the tubular assembly to a certain amount of flexion without risking buckling the feedpipe.

To assure the assembly of the various sections of the tubular assembly, each section can have at one of its ends a male thread, and at its other end, a nut possessing a corresponding interior thread, axially movable between two stops.

BRIEF DESCRIPTION OF THE DRAWINGS

We will now described, by way of a non-limiting example, a particular embodiment of the invention, making reference to the diagrammatic drawings, in which.

DESCRIPTION OF THE PREFERRED EMBODIMENT

Figure 1:
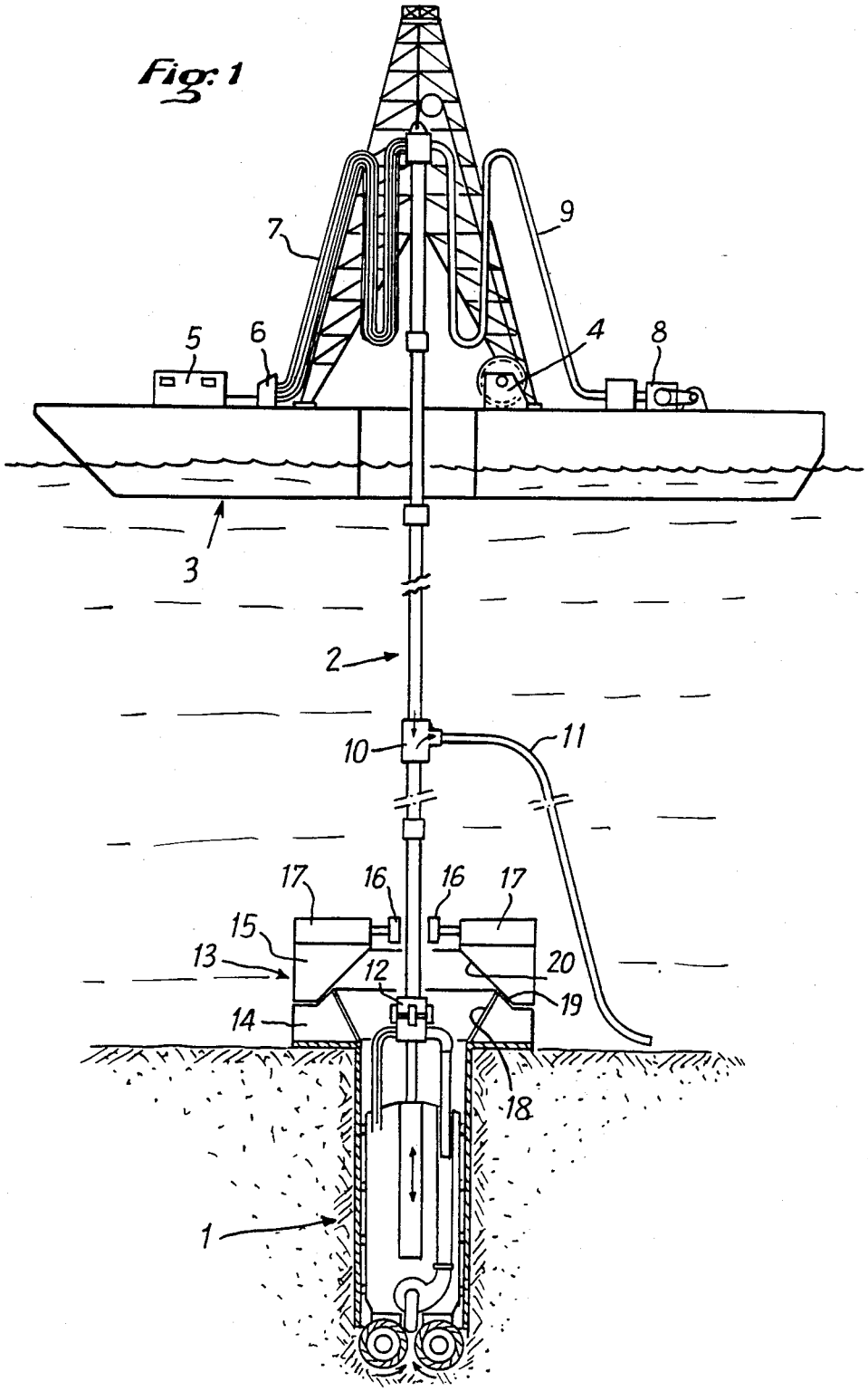
FIG. 1 is an overall view of the device, according to the invention, and of a ship from which it is used.

FIG. 1 represents in a general way the drilling unit 1 linked by a series of boring rods 2 to the operating vessel 3 which can be a dynamically positioned ship.

The rod string 2 is suspended from the ship by its upper part, with the aid of a handling winch 4. The ship 3 has a hydraulic power station 5 able to furnish hydraulic fluid by way of a control board 6 and a plurality of flex hoses 7 to the upper end of different hydraulic flow pipes provided for in the series of rods 2.

The ship 3 supports a mud pump 8 linked by a refilling flex hose 9 to the upper part of a mud-injection pipe also provided in the rods 2. This series of rods, like the different hydraulic fluid and mud pipes, is described in further detail later, specifically with reference to FIGS. 6–10.

A distribution box with three channels and two positions is inserted in the rod string 2, with its third channel being joined to one end of a flexible pipe 11 for dredging. This box 10 will be described in more detail in reference to FIGS. 4 and 5.

The lower end of the rod string 2 is linked to the top of the drilling unit 1 by an intermediate connector 12 which will be described in more detail in reference to FIGS. 11*a* and 11*b*.

On the wellhead, on the ocean bottom, rests a guiding and clamping body 13. This body 13 is composed of a lower structure 14 and an upper structure 15, the clamping jaws 16for the series of rods being mounted on the upper structure 15, these being activated by electric cylinders 17.

The lower structure 14 forms two bodies to serve as guide surfaces 18 and 19, respectively. The guide surfaces 18 form a re-entry cone, allowing the drilling unit to be guided into the drilling area if, for any reason, the drilling unit has had to be withdrawn. Guide surfaces 19 work with other guide surfaces 20 on the upper structure, insuring such a re-entry will allow correct repositioning between the lower structures 14 and the upper 15. It is thus demonstrated that the drilling unit will carry along the upper structure which will have to be repositioned in case the drilling unit undergoes extraction and subsequent re-entry.

Figure 2A:
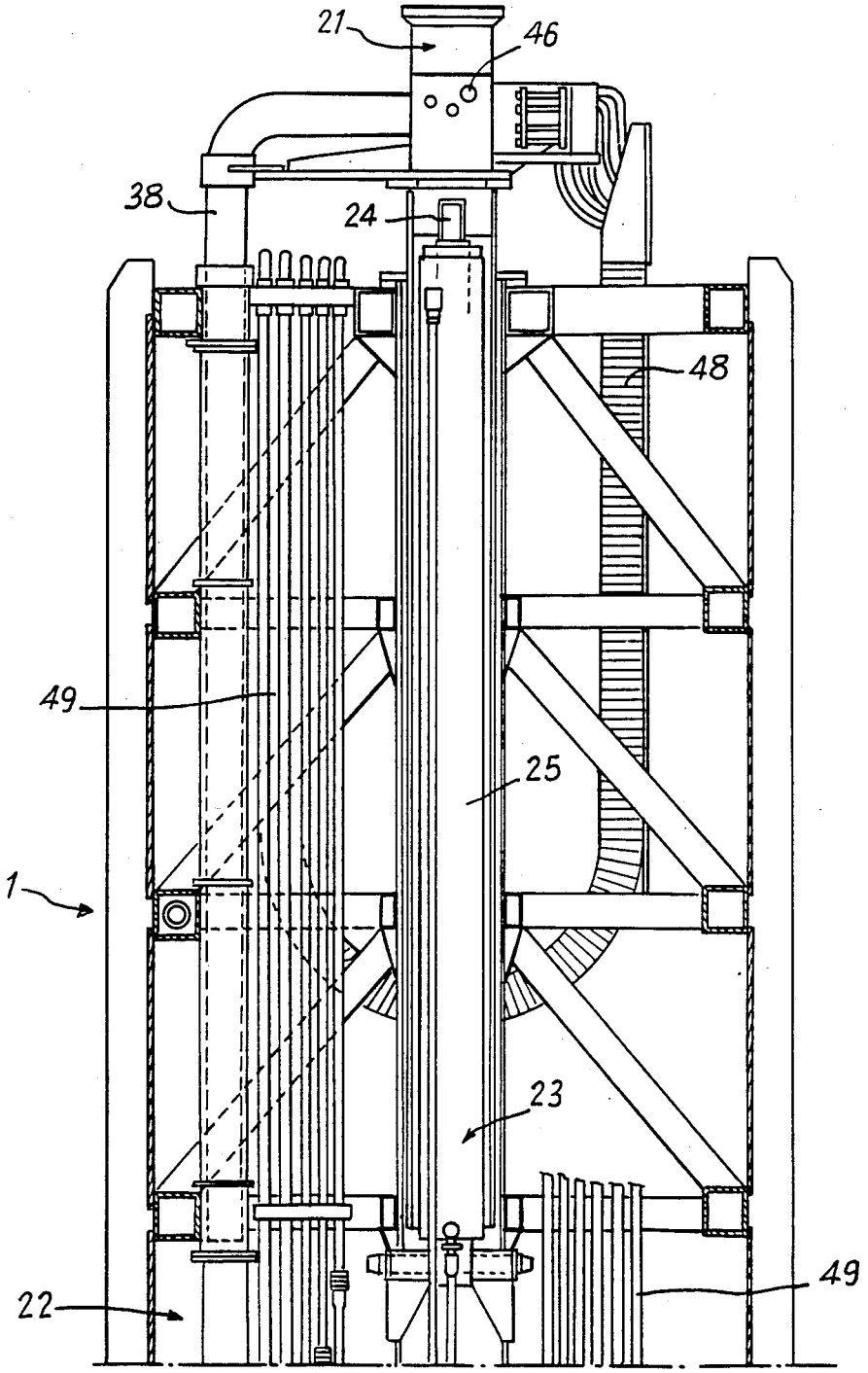
FIGS. 2*a* and 2*b* are views on a larger scale, respectively, of the upper part and of the lower part of the drilling unit of the device.
Figure 2B:
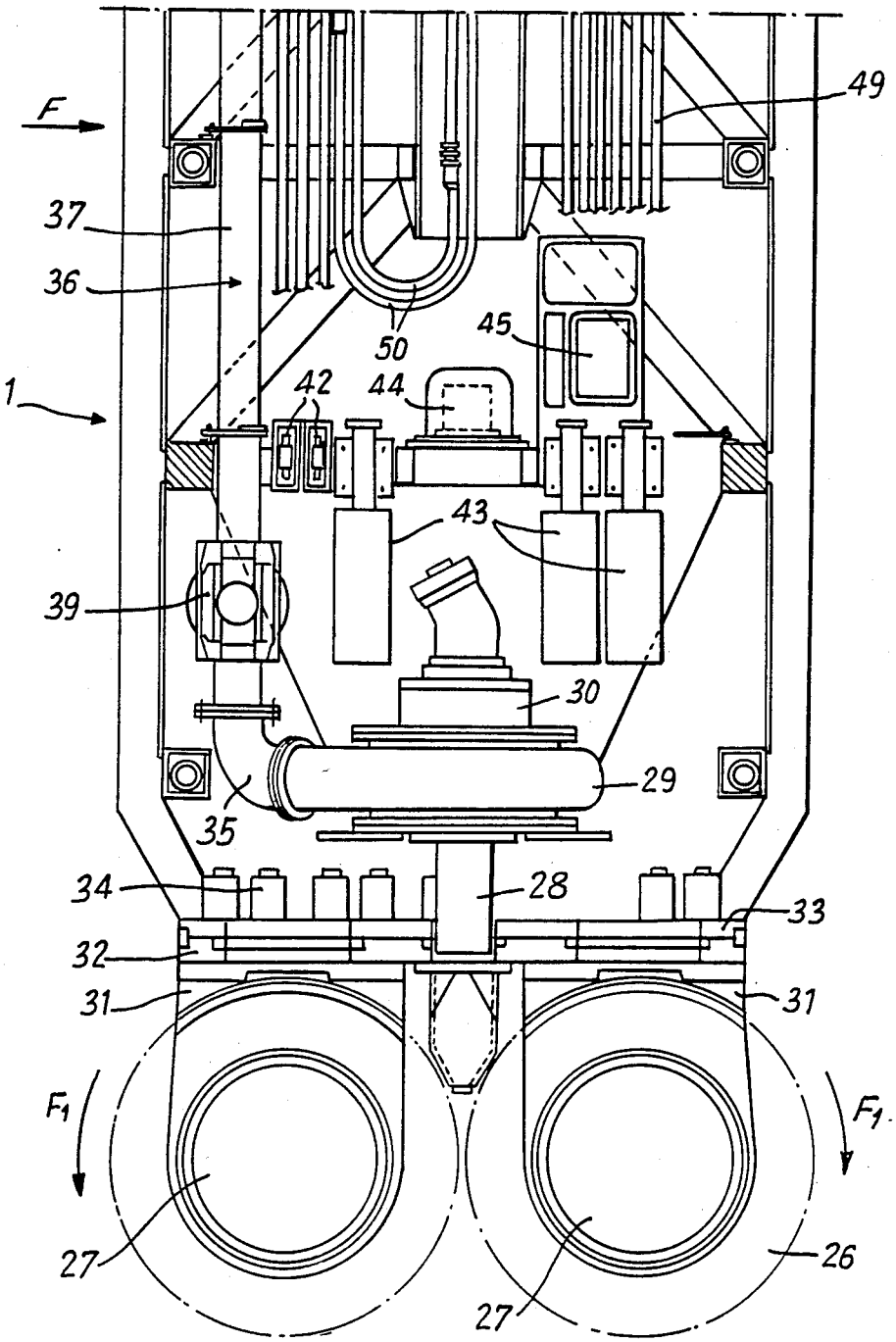

FIGS. 2*a* and 2*b* portray the drilling unit 1, comprised of a head 21, a body 22 and a cylinder 23. The head 24 of the rod of the cylinder 23 joins the head 21 of the drilling unit so that the body 25 of the cylinder joins the body 22 of the drilling unit, allowing the cylinder 23 to regulate the vertical adjustment between the head 21 and the body 22 of the drilling unit.

The body 22, in its lower part, contains two cutters 26 driven in opposite directions, as shown by arrows F1, by hydraulic motors 27 so that the mud is pulled towards the opening of a suction pipe 28 of a dredging pump 29 operated by another hydraulic motor 30.

The cutters 26 and the motors 27 are mounted on vertical plates 31, mutually mounted on a horizontal supporting plate 32.

Plate 32 is mounted on a horizontal base plate 33 by intermediate cylinders (not shown) placed between plates 32 and 33. Springs 34 cause plates 32 and 33 to press against each other, in such a way that with the aid of the cylinders, plate 31 will tilt to the vertical, causing the cutters 27 to extend beyond the envelope of the unit's casing. Such an arrangement is described in document FR-A-No. 2 536 455.

Figure 13A:
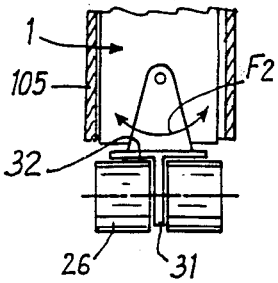
FIGS. 13*a*–13*c* show the swinging of the cutter on the drilling unit.
Figure 13B:
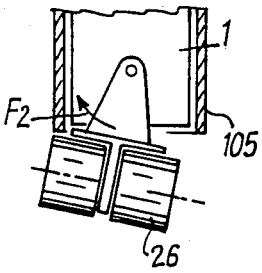
Figure 13C:
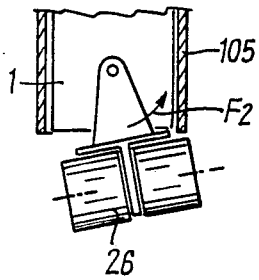

One will note that FIGS. 13*a*–13*c* illustrate the inclination of cutter 26 in a rotating fashion around a horizontal arbor, which is not actually shown in the embodiment of FIG. 2*b*.

The outlet 35 of pump 29 is joined to the drilling unit's head by an intermediate telescopic pipe 36, comprised of sliding inner and outer tubes 37 and 38, respectively. The lower part of tube 37 is joined to the outlet 35 of the pump whereas the upper part 38 of the tube joins the head 21. Moreover, a desitometer 39 is installed on tube 37 so as to control the density of the mud. It will be noted later that the mud is not drawn up to the ship and thus cannot be directly controlled.

Figure 3:
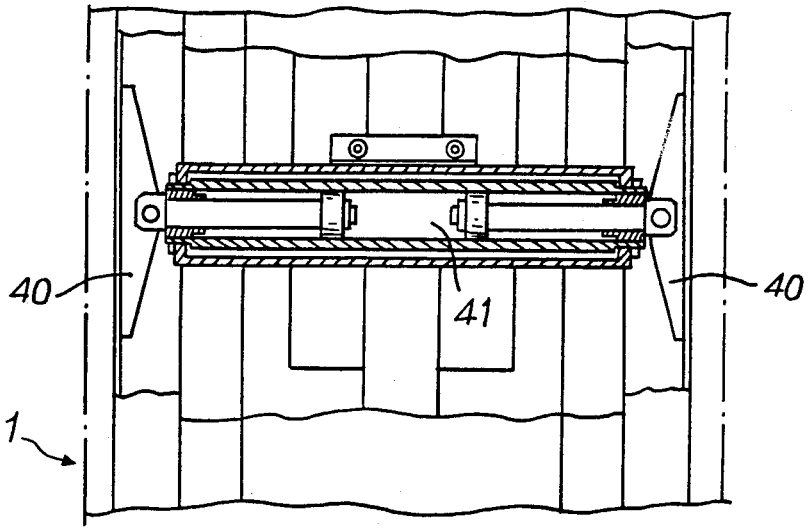
FIG. 3 is a view in section along arrow F of FIG. 2*b;*

In the transverse direction, shoes 40 (FIG. 3) activated by cylinders allow the drilling unit to operate interdependently with the tubing.

Cylinders 41 as well as those (not shown) for inclining the cutters 26 are fed by electrical distributing devices 42.

The drilling unit also includes pressurized balancing bladders 43 for the excavating pump joints, the motor joints 27 and the joints between sloping plates 32 and 33. Moreover, the drilling unit is equipped with an inclinometer 44 and a gyrocompass 45, allowing the drilling unit 1 to be positioned angularly around its three axes.

The feeder pipes pass hydraulic fluid through the rod string into the head 21 of the drilling unit. These pipes extend from the head 21 at 46 where they are connected to other pliable pipes 47 entering into two equally pliable casings 48 (only one casing is herein depicted). The pipes 47 and casings form a loop, one end of which is consequently linked to the head 21, and the other end of which is linked to the body, allowing relative movement of the head and the body. On the extreme side of the body, the pliable pipes 47 are connected to rigid tubes 49, assuring the distribution of hydraulic fluid to various motors and cylinders. Only the feeding of the cylinder by way of the conduits is represented here.

Figure 6:
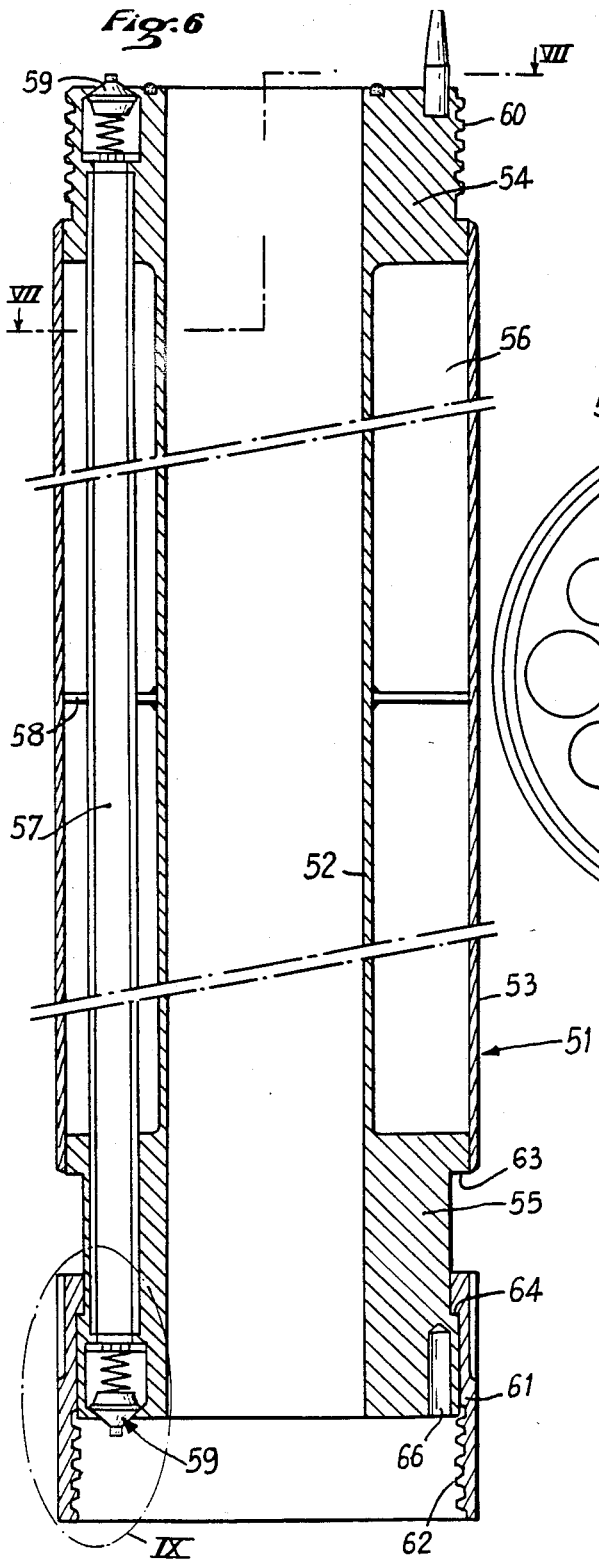
FIG. 6 is an axial view in section along line VI—VI of FIG. 7 of a rod of the tubular assembly according to this invention.
Figure 7:
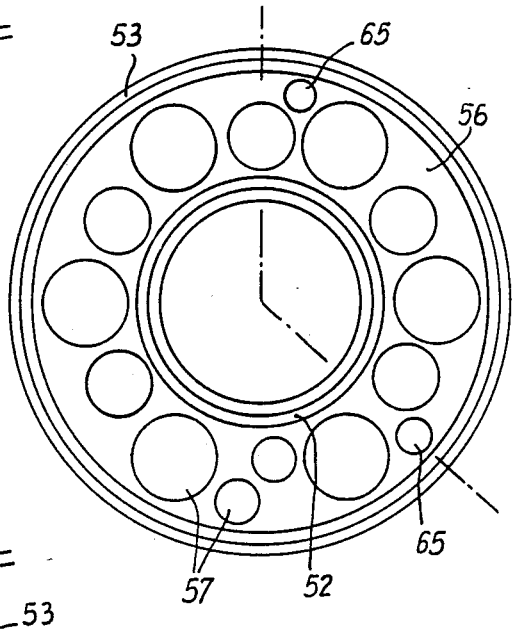
FIG. 7 is a cross-section taken along the line VII—VII of FIG. 6.

We will now describe the rod string 2 making particular reference to FIGS. 6 and 7.

The series of rods is composed of individual rods 51, formed by a central channel 52 and an outer casing 53. The channel 52 and casing 53 are welded together at both upper and lower ends 54 and 55, in such a way that they remain concentric.

In the annular space 56 thus formed, there are disposed feeding pipes for hydraulic fluid, designed to reach the various hydraulic instruments of the drilling unit. The pipes 57 are mounted at their ends to the joints 54 and 55 and will be described in such a fashion hereafter; they are held in place by braces 58. Moreover, the pipes 57 are equipped on each end with blocking valves 59 also described hereafter.

A screw thread 60 encircles the upper periphery of the upper joint 54 so that the lower threading 61 corresponds to the upper, and slides over the inner joint between upper and lower thrust bearings 63,64.

Two tapered centering pins are also mounted on joint 54, and joint 55 is equipped with corresponding holes, allowing the centering of the two rods 51 as well as angular correspondence between two homologous channels.

Figure 10:
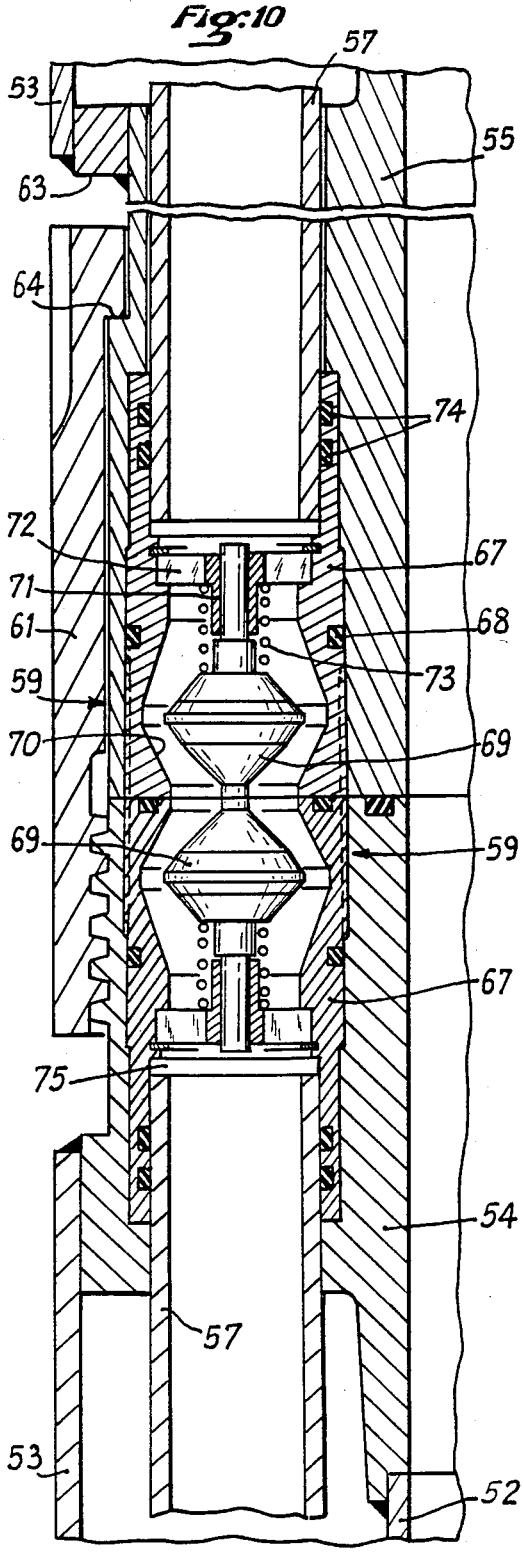
FIG. 10 is a view in larger scale of detail X of FIG. 8*c*.
Figure 9:
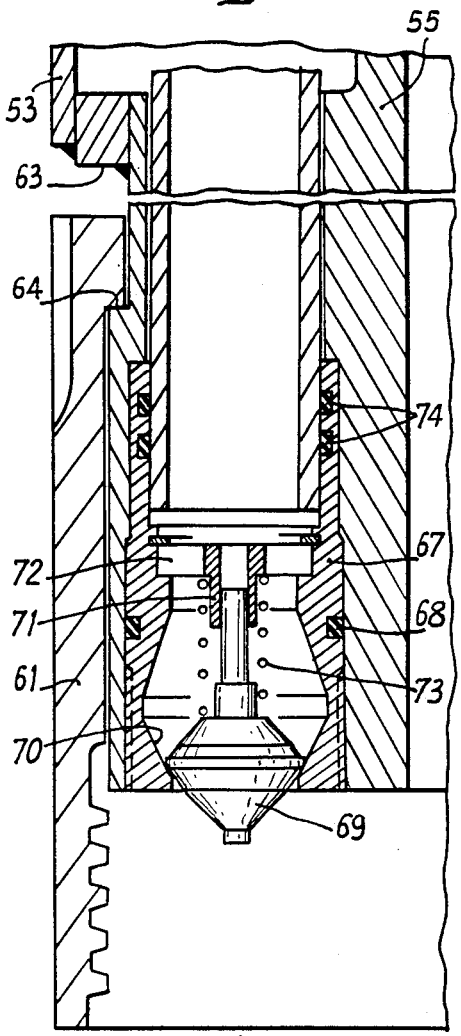
FIG. 9 is a view in larger scale of detail IX of FIG. 6.

FIGS. 9 and 10 present a detailed description of the valves 59. These valves essentially comprise a valve body 67 screwed into joints 54 and 55. O-rings 68 provide impermeability between the valve's body and the joint.

A conical valve member 69 is mounted in the body 67, movable axially between a blocked position (FIG. 9) where it is supported on a seat 70 created in the body 67, and an open position where it engages an abutment 71 maintained in a central position by a cross-bar 72.

A helical spring 73 allows the blocking member to be applied to the seat 70 when the rod string's end is free. Contrarily, when two rods are screwed together (FIG. 10), the two members 69 push simultaneously together to open the valves.

FIGS. 9 and 10 also show the casing to slip over the channel ends on joints 54 and 55. O-rings 74 insure the impermeability of the channel ends and the valve bodies 59.

One also sees on these figures that slight freeplay 75 has been provided at the channel ends in order to prevent buckling in the event that the rods flex.

Figures 8A, 8B, 8C:
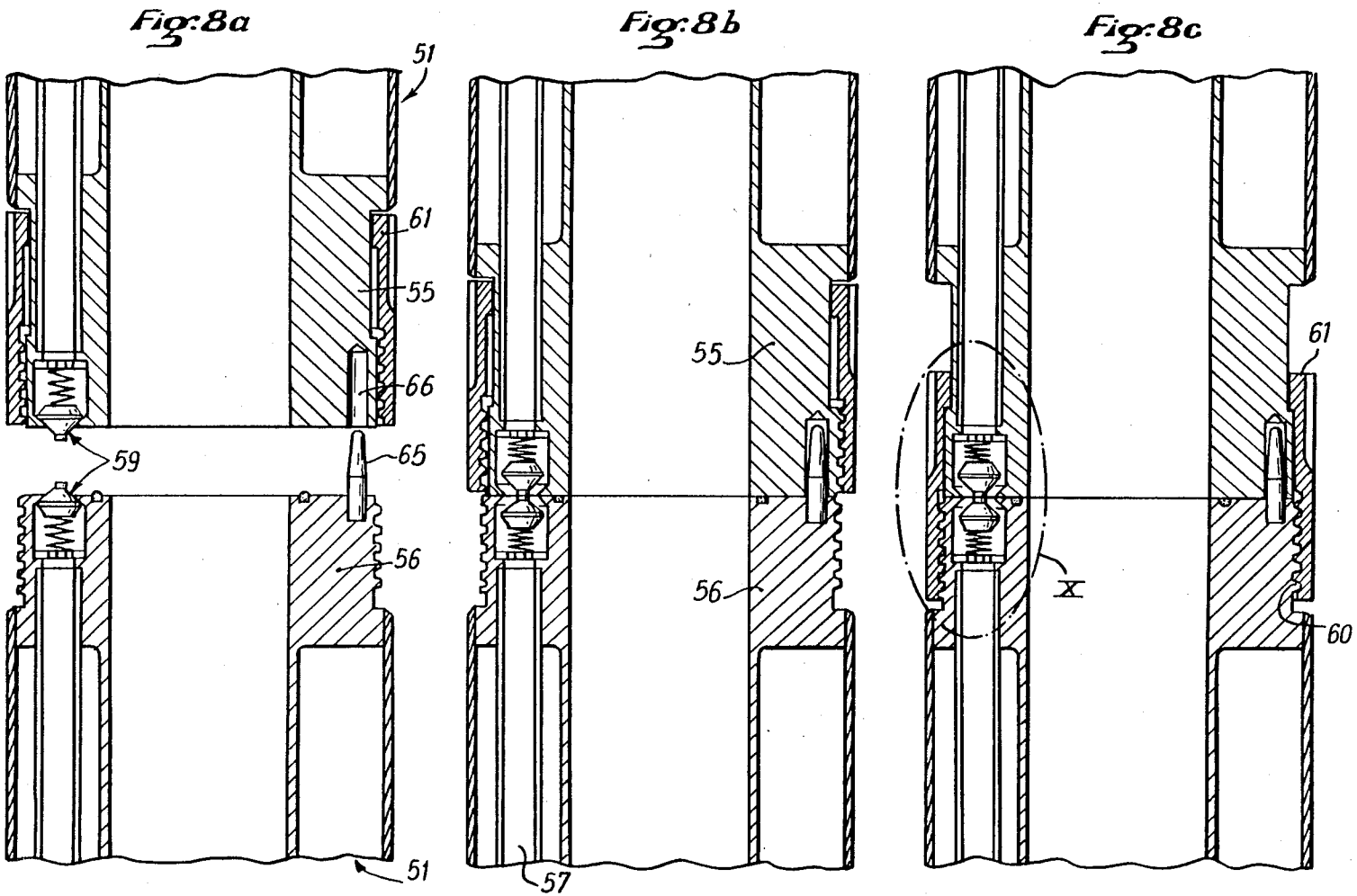
FIGS. 8*a*–8*c* represent the method of assembly of two rods like those in FIGS. 6 and 7.

FIGS. 8*a* to 8*c* illustrate the assembly of the two rods 51.

The two rods are presented face to face, the screw of the upper rod remaining in an upper position by the most convenient means. In this position, the valves 59 are closed. Joints 55 and 56 of the upper and lower rods respectively are then brought into contact (FIG. 8*b*). This movement is guided by the insertion of the conical points into the holes of the upper rod. As the movement is executed, the elements of valves 59 mutually depress each other to activate the respective channels 57.

Finally, the two rods 51 are assembled by screwing the thread 61 of the upper rod to the lower rod.

This operation should take place on board the ship, the lower rod being connected to the upper rod of the series of rods 2 already assembled and being held in place by two clamps (not shown), the upper rod 51 being suspended from the winch 4.

In operation, the uppermost rod of the rod string 2 is linked through its central channel and at its upper part to the end of the dredging flex hose; the feeder pipes for hydraulic fluid are linked on their upper ends to hydraulic flexible tubes.

Figure 4:
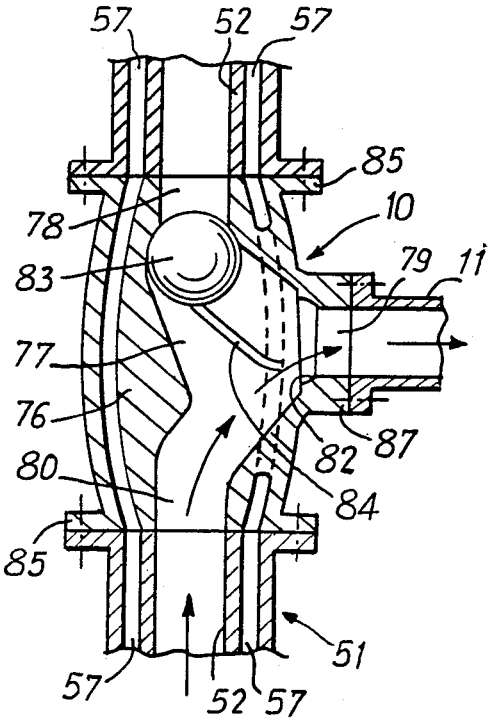
FIGS. 4 and 5 represent, respectively, in each of its positions a three-channel distribution box used in the device according to the invention.
Figure 5:
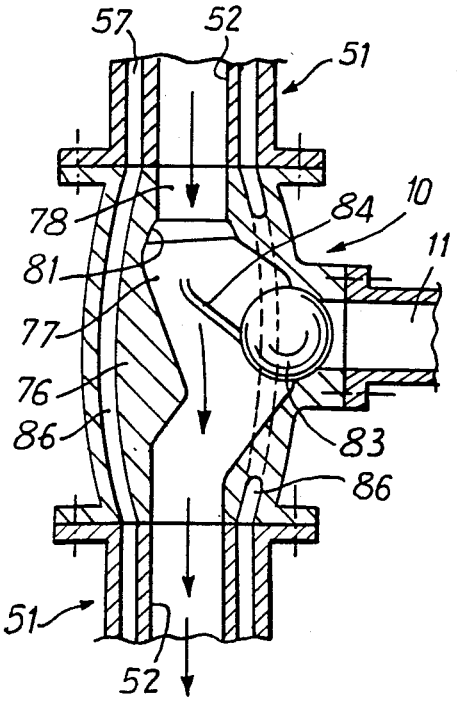

We will now describe the three-channeled distribution box 10, making reference to FIGS. 4 and 5.

The distribution box 10 is comprised of a body 76 defining a distribution chamber 77. The chamber 77 has an upper mouth 78, a side mouth 79, and a lower mouth 80.

The upper mouth 78 is equipped with a seat 81, and the side mouth 79 is provided with a seat 82.

A plugging sphere 83 is disposed in the chamber 77, and can seat against either seat 81 or against seat 82.

Movement of the sphere 83 between seats 81 and 82 is guided by a rib 84 formed on the inner wall of the chamber 77.

Connectors 85 similar to those described on the rod ends, are provided at the upper and lower ends of the distribution box 10, so that the box 10 remains in and intermediate position between two rods 51 of the rod string 2. Around the chamber 77 is a channel 86 allowing hydraulic fluid pipes 57 to pass between the upper and lower rods 51.

The chamber's mouth 79 is designed to couple with the mud evacuation pipe 11.

As the mud flows from the pump 29 into the lower rod's channel, the pressure thus created within the chamber 77 causes the sphere 83 to press against the seat 81 and block the upper rod's channel 52. Thus the mud is directed toward the delivery pipe 11 (FIG. 4).

When the drilling unit 1 is brought back from the bottom to the wellhead, we will see hereafter that the mud is to be injected into the drilling area. The mud is injected through the central channel, by way of the lower rod, and creates pressure against the plug inside the delivery pipe. Thus the mud is directed towards the channel 52 of the lower rod 51.

Figure 11B:
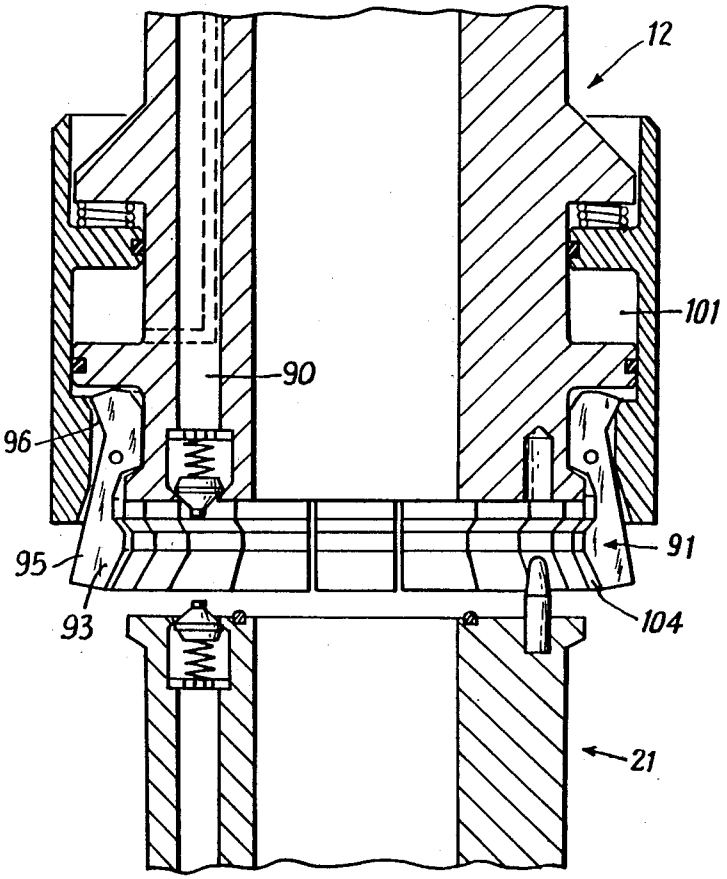
FIGS. 11*a* and 11*b* are axial views in section of the connector used according to the invention, in closed and opened positions respectively.
Figure 11A:
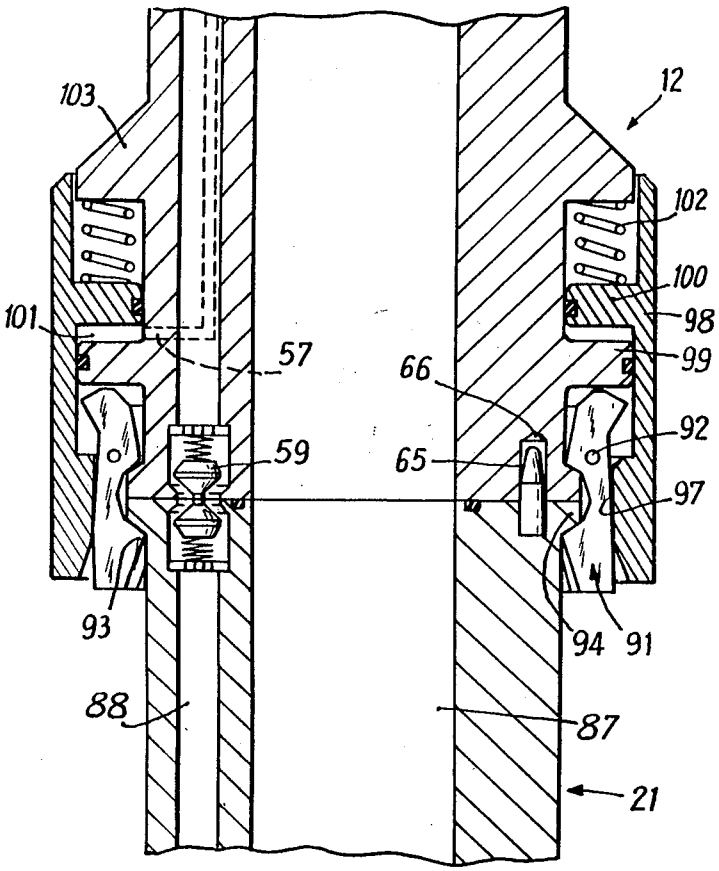

We will now describe the connector 12, making reference to FIGS. 11*a* and 11*b*.

The head 21 of the drilling unit 1 is comprised of a central conduit, which is linked to tube 38 and also to a plurality of channels bearing hydraulic fluid.

The design of channels 87 and 88 corresponds to that of pipes 52 and 57 of rods 51.

Additionally, connector 12 comprises central and peripheral channels 90 of the same design. Connector 12 is mounted upon the lower part of the rod string by means similar to those seen in the two rods 51.

Valves 59 and centering points 65 are provided as before.

A ring of gripping elements 91 pivoting on horizontal axes 92, is provided on the structure of the connector's lower part. The lower part of the elements 91 are formed as hooks 93, allowing them to grasp a flange 94 formed on top of the head 21 of the drilling unit.

The element's outer surfaces are in cam form. The surfaces comprise both a lower surface 95 and an upper surface 96 designed to cooperate with corresponding surfaces 97 formed inside the lower part of a skirt 98 slipped over the connector 12.

An external annular projection 99 on the body of the connector cooperates with an internal annular projection 100 on the skirt 98 to form an annular piston chamber 101, fed by one of the conduits 57.

The annular hydraulic cylinder thus formed tends, when activated, to force the skirt to the top, against the action of helical springs 102 placed between the projection and a collar 103 on the body of the connector.

When connected, as in FIG. 11*a*, the springs 102 keep skirt 98 in a lowered position in which the surface 97 presses against the surfaces 95 of elements 91 cause a clamping action on flange 94. However, in the disconnect position of FIG. 11*b*, hydraulic fluid is injected into chamber 101, causing the skirt to rise against the action of the springs 102, in such a way that the surface 97 cooperates with the surfaces 96 to cause ends 93 of elements 91 to flip outwards and thus release flange 94.

Moreover, we note that the inner lower surfaces 104 of gripping elements 91 form a truncated cone, insuring that flange 94 will be properly guided as the elements 91 open.

The centering of this connection is insured as was previously described in relation to rods 51 by way of points 65; the opening of valves 59 occurs when connector 12 makes contact with the drilling unit's head 21.

This arrangement of facilitates swift disconnection of the rod string from the drilling unit, if needed, and guarantees an equally simple reconnection when drilling operations are resumed.

Figures 12A, 12B, 12C, 12D, 12E:
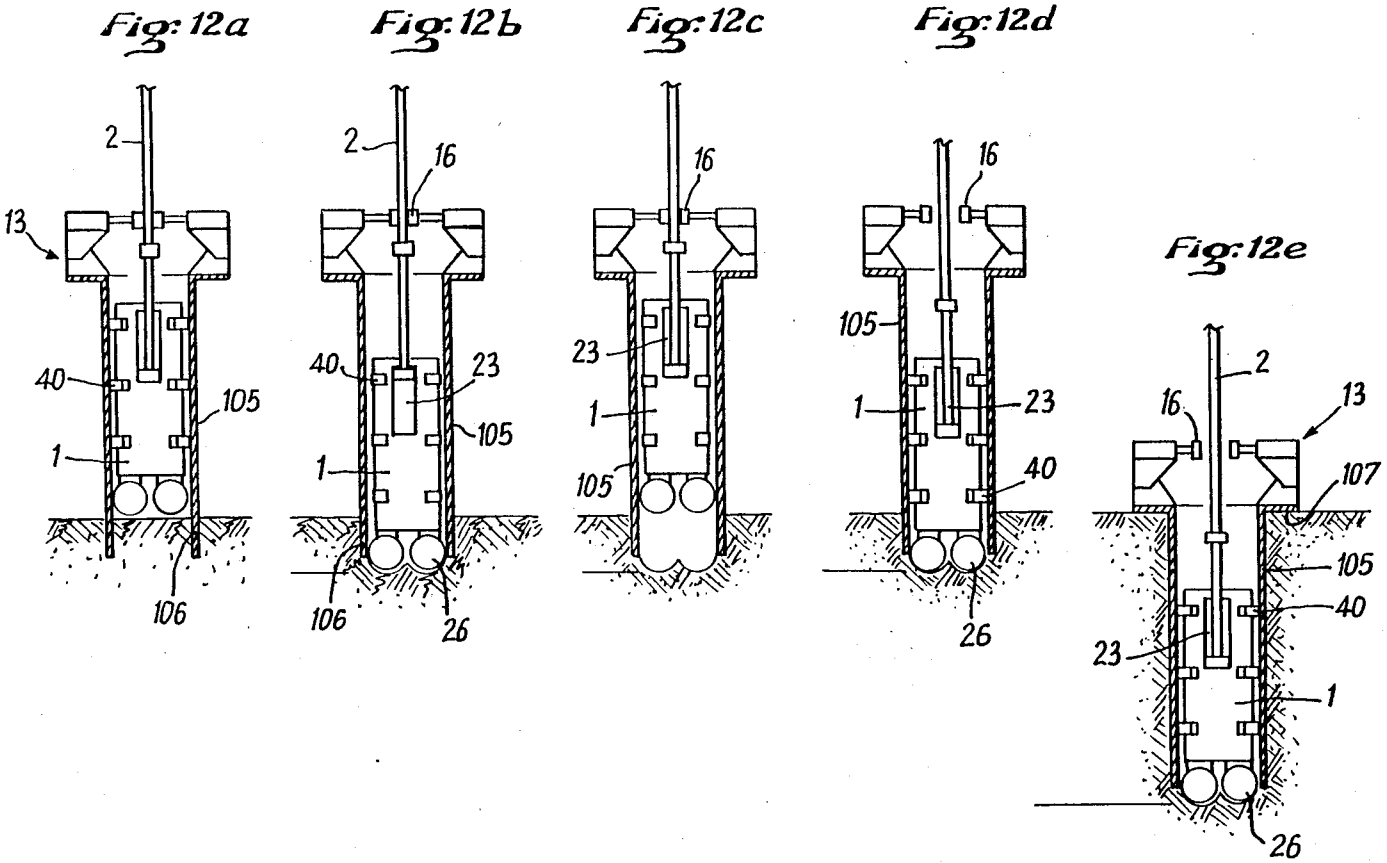
FIGS. 12*a*–12*n* illustrate the operation of the device according to the invention.
Figure 12L:
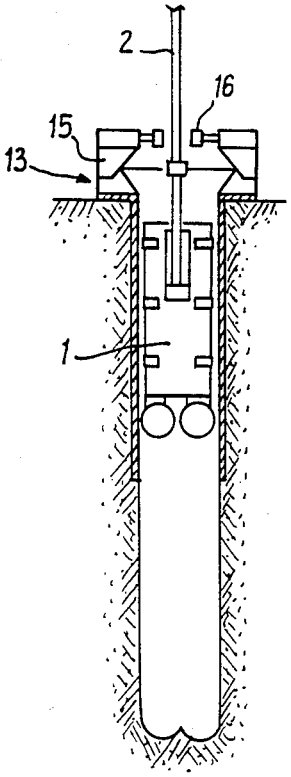
Figure 12M:
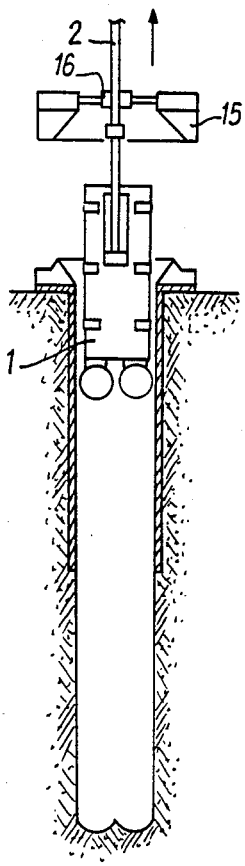
Figure 12N:
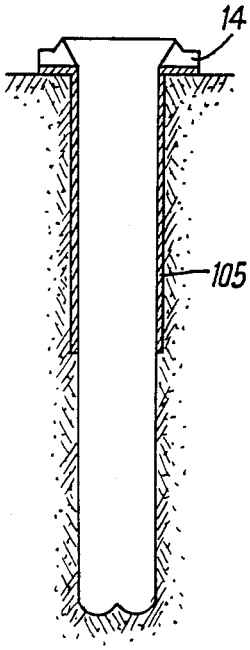

We will now describe, according to the invention, the use of the device, making reference to FIGS. 12*a* through 12*n*.

FIG. 12*a* shows the drilling unit 1 disposed inside casing 105, designed to insure that the upper part of the drilling unit remains stable. Drilling unit 1 is suspended from the ship by the series of rods 2, and partially supports the guiding and blocking structure 13 as well as casing 105 by means of shoes 40 in their deployed position.

Moreover, it is noted that drilling unit 1 is completely confined in casing 105 so that when the apparatus reaches the ocean bottom, the drilling unit's lower part 106 enters the earth where the drilling will take place. Thus drilling unit 1 will be properly guided from the start of drilling.

FIG. 12*b* shows the brakes retracted so that the drilling unit can separate from the casing. The clamps 16 are tightened on the rod string 2, and drilling unit 1 is lowered by cylinder 23 as the cutters 26 disengage the inner part of the casing 106.

Drilling unit 1 is brought back into the casing 105 by the aid of cylinder 23, the clamps 16 remaining closed (FIG. 12*c*).

Clamps 16 are then opened (FIG. 12*d*) again lowering drilling unit 1 into the casing 105 with the ship's winch 4, the cylinder 23 remaining retracted.

Shoes 40 thus relink drilling unit 1 and casing 105 by remaining deployed.

Thus drilling begins, as represented as FIGS. 12*d* and 12*e*, with cylinder 23 retracted, and drilling unit 1 and its casing 105 suspended from the ship by the rod string. During this phase of the operations, clamps 16 remain open. Thus casing 105 descends with drilling unit 1 until the drilling unit's upper plate 107 and body 13 come in contact with the ocean bottom.

During this phase of operation, at the same time that the cutters 26 rotate, they undergo a swinging movement (as depicted by arrows F2 of FIGS. 13*a* through *c*) so that the drilling unit maintains, in at least one of its directions, a slightly larger dimension than the casing 105 in order to facilitate drilling.

FIGS. 12*f* through *k* depict subsequent phases of drilling.

We note firstly that in all subsequent phases, shoes 40 are retracted, with the casing 105 resting in place while drilling unit 1 completes drilling and is withdrawn.

Figures 2K, 12F, 12G, 12H, 12I, 12J:
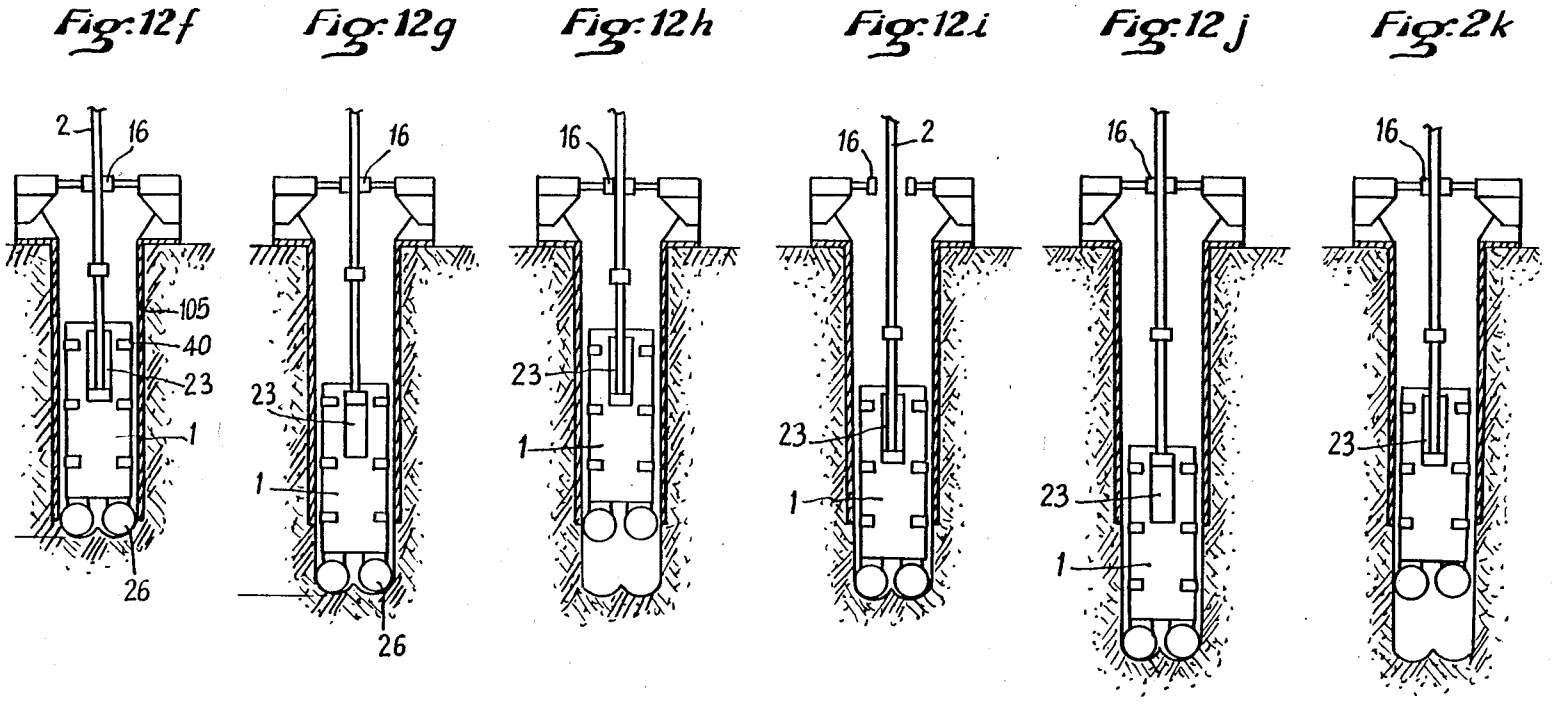

In FIG. 12*f*, clamps 16 are closed onto rod string 2 and cylinder 23 is in a retracted position.

When the cutters 26 are in action, drilling unit 1 is lowered by cylinder 23 (FIG. 12*g*) and then brought up again by cylinder 23 (FIG. 12*h*), clamps 16 remaining closed. These clamps are then opened (FIG. 12*i*) and drilling unit 1 is again lowered to he bottom of the drilling area by winch 4 and rod string 2, cylinder 23 remaining in a retracted state.

Clamps 16 are then closed again, and drilling unit 1 is relowered by cylinder 23 for a new section of drilling rod (FIG. 12*j*) and then brought up (FIG. 12*k*).

This cycle repeats itself until completion of the drilling, when drilling unit 1 is brought up by rod string 2, clamps 16 being open (FIG. 12*l*).

While the drilling unit is being brough up, mud is injected into the driling area to insure the stability of the drilling unit's walls. This mud is injected through channels 52, gate 10 being in a position blocking the mud evacuation pipe 11.

When drilling unit 1 reaches the ocean bottom, upper structure 15 of assembly 13 becomes connected to this drilling unit, by clamps 16, so that structure and drilling unit can be brought up to the ship simultaneously by rod string 2. FIG. 12*n* shows completion of the drilling with its upper part tubed and lower structure 14 of assembly 13 permitting standrad operations of installation and cementation of the drilling unit and/or eventually to re-engage drilling unit 1 in drilling operations.

Many variations and changes may of course be applied to the preceding description without affecting the framework or essence of the invention.

Above all it is possible that a driling unit differeing from that represented in FIGS. 2*a* and 2*b* may be employed.

By the same token, it is possible to submerge the hydraulic power station and not have it installed on the ship, as is shown in FIG. 1.

Moreover, the terms "mud" (or "drilling fluid") are by not means limiting, and particularly include all similar substances where subsequently used.

We claim:

1. A device for offshore drilling for foundations, comprising:

a drilling unit including a head (21) and a body (22) interconnected by at least one hydraulic cylinder (23), said body being equipped with at least one cutter (26), said unit being further equipped with at least on pump (29) for discharging cuttings, and with hydraulic motors (27, 30) to drive said cutter and said pump, a rigid tubular assembly (2) having at least one discharge pipe (52) for discharging the cuttings, and pipes (57) for feeding said cylinder and said motors with hydraulic fluid, connecting means (12) between the head of said drilling unit and a lower end of said tubular assembly, support means (13), able to be placed onthe seabed in front of the drilling unit, for clamping means (16) of said tubular assembly, and means for suspending the device from a ship (3), means (5) being provided for the furnishing of hydraulic fluid, and connection pipes being provided between said fluid-furnishing means and an upper end of said tubular assembly.

2. A device according to claim 1, wherein said body is equipped with two cutters, with horizontal axes, rotatable in opposite directions, wherein the cutters are mounted to swing around horizontal axes, hydraulic cylinders being provided to cause them to swing, and wherein said tubular assembly has feed pipes for said cylinders.

3. A device according to claim 1 further comprising, at the upper part of said tubular assembly, a distribution box (10), having three channels, with a two-position check vales, a first one (80) of the channels being connected to said discharge pipe, a second channel (79) being connected to a piper (11) for evacuating the cuttings, and a mud feed pipe connected between a third channel (78) and a mud production unit (8) installed on said ship, the discharge pipe being connected to the evacuation pipe in the first position of the valve, and to the mud feed pipe in the second position of the valve.

4. A device according to claim 3, wherein said distribution box comprises a distribution chamber (83) in which a plugging element is guided to move between a first seat (82) where it plugs the opening of the second channel and a second seat (81) where it plugs the opening of the third channel, the plugging element being automatically applied against said second seat when cuttings are discharged in the discharge pipe for the evacuation of said cuttings by the evacuation pipe, and against said first seat when drilling mud is injected in the mud feed pipe for the injection of said mud in the drilling by said discharge pipe.

5. A device according to claim 4, wherein said plugging element in a sphere guided in the distribution chamber by ribgs (84) formed on the walls of said chamber.

6. A device according to claim 1, wherein said connecting means between the head of the drilling unit and the lower end of the tubular assembly comprise a connector, placed at said lower end of the tubular assembly, that can be operated by a least one hydraulic cylinder, said tubular assembly comprising feed pipes for said cylinder.

7. A device according to claim 6, wherein said hydraulic cylinder is an annular cylinder having a movable element (98) forming a skirt placed around said lower end of the tubular assembly, movable between two stops (99, 103) limiting its axial travel, said connection comprising a plurality of gripping elements (91) adapted to grip a flange (49) formed on the head of the drilling unit, said gripping elements being mounted on the periphery of said lower end of the tubular unit on horizontal axes of rotation (92) and having cam surfaces (59, 96) cooperating with corresponding surfaces (97) of said skirt so as to rock from a locking position when said skirt is in one of its axial positions to an unlocking position when said skirt is in its other axial position.

8. A device according to claim 7, wherein said cylinder is a single-acting cylinder, said skirt being able to be brought from its locking position to its unlocking position under the action of hydraulic fluid against the action of elastic means (102) tending to return the skirt back to its locking position, the gripping elements and said flange possessing cooperating surfaces (104) to separate said gripping elements when said cooperating surfaces are pressed against one another.

9. A device according to claim 6, wherein one of the lower end of the tubular assembly and the head of the drilling unit has tapered centering pins (65) cooperating with corresponding holes (66) in the other, so as to cause each opening of the pipes of the tubular assembly to correspond angularly with corresponding feed openings of the drilling unit.

10. A device according to claim 9, wherein the lower ends of each hydraulic fluid pipe of the tubular assembly, as well as the corresponding feed openings of the head of the drilling unit, are equipped with check valves (59) made to close when the lower end of the tubular assembly is disconnected from the drilling unit, and to open when the lower end of the tubular assembly is connected to the drilling unit.

11. a device according to claim 1, wherein the output (35) of the pump for discharging cuttings is connected to the head of the drilling unit by a telescopic discharge pipe (36).

12. A device according to claim 1, wherein said support means comprise a lower structure (14) equipped with first guide surface (18) for the lower part of the drilling unit, and an upper structure (15) equipped with a guide surfaces (20) able to cooperate with a second guide surface (19) of the lower structure, said makeup means being mounted on said upper structure.

13. A device according to claim 1, further comprising means (40) for coupling a casing (105) around the drilling unit, that can be operated by hydraulic cylinders (41), said tubular assembly having feed pipes for said cylinders.

14. A device according to claim 13, wherein the coupling means comprise skids mounted on opposite faces of the drilling unit.

15. A device according to claim 1, wherein said rigid tubular assembly is extended to the ship.

16. A device according to claim 1, wherein said rigid tubular assembly is made in the form of joinable sections (51), each of the sections having a central pipe (52) for discharging of cuttings or injecting of mud, and hydraulic fluid feed pipes (57) placed on the periphery of the central pipe, and further comprising means (65, 66) for assuring the relative angular positioning of two adjacent sections so as to cause the openings of their counterpart feed pipes to correspond.

17. A device according to claim 16, wherein at least one end of a section has tapered centering pins (65) able to cooperate with corresponding holes (66) formed in the end opposite the adjacent section.

18. A device according to claim 16, wherein each end of each hydraulic fluid feed pipe of a section is equipped with a check vale (59) made to be closed when said section is not joined on the side of this end, and to be open when said section is joined on the side of this end to an adjacent section.

19. A device according to claim 16, wherein said section has an outer protective sheath (53), the hydraulic fluid feed pipes being placed in the annular space (56) between the central pipe and the outside sheath.

20. A device according to any claim 16, wherein said hydraulic fluid feed pipes are mounted to slide at their ends, in a tip (54, 55) solid with the end of the central pipe.

21. A device according to claim 16, wherein each section has at one of its ends a male thread (60) and, at its other end, a nut (61) processing a corresponding interior thread (62), axially mobile between two stops (63, 64).

* * * * *